US007036578B2

(12) United States Patent
Austbo et al.

(10) Patent No.: US 7,036,578 B2
(45) Date of Patent: May 2, 2006

(54) TUBING GUIDE AND COILED TUBING INJECTOR

(75) Inventors: Larry L. Austbo, Duncan, OK (US); Joshua N. Andersen, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 301 days.

(21) Appl. No.: 10/423,320

(22) Filed: Apr. 25, 2003

(65) Prior Publication Data

US 2004/0211555 A1 Oct. 28, 2004

(51) Int. Cl.
*E21B 19/22* (2006.01)

(52) U.S. Cl. ..... 166/77.2; 166/85.5; 175/423; 226/173; 226/167

(58) Field of Classification Search ..... 166/381, 166/77.1–77.3, 77.53, 75.14, 85.5; 226/172, 226/173, 167, 162, 163; 242/397.1, 615.3; 175/423

See application file for complete search history.

(56) References Cited

U.S. PATENT DOCUMENTS

| | | | | | |
|---|---|---|---|---|---|
| 1,802,565 | A * | 4/1931 | Lacey | 83/461 |
| 2,105,636 | A * | 1/1938 | Creed | 175/423 |
| 3,434,191 | A | 3/1969 | Timmons | 29/200 |
| 4,162,704 | A | 7/1979 | Gunther | 166/77.5 |
| 4,585,061 | A * | 4/1986 | Lyons et al. | 166/77.3 |
| 4,655,291 | A | 4/1987 | Cox | 166/385 |
| 5,031,695 | A * | 7/1991 | Cain et al. | 166/75.14 |
| 5,094,340 | A | 3/1992 | Avakov | 198/626.1 |
| 5,279,364 | A * | 1/1994 | Jantzen et al. | 166/77.3 |
| 5,467,825 | A * | 11/1995 | Vallet | 166/379 |
| 5,553,668 | A | 9/1996 | Council et al. | 166/77.3 |
| 5,590,713 | A | 1/1997 | Baugh et al. | 166/53 |
| 5,799,731 | A | 9/1998 | Avakov et al. | 166/77.2 |
| 5,875,850 | A | 3/1999 | Burge et al. | 166/385 |
| 5,918,677 | A | 7/1999 | Head | 166/380 |
| 5,988,274 | A | 11/1999 | Funk | 166/77.4 |
| 6,032,744 | A | 3/2000 | Burge et al. | 166/385 |
| 6,209,634 | B1 | 4/2001 | Avakov et al. | 166/77.3 |
| 6,412,560 | B1 * | 7/2002 | Bernat | 166/301 |
| 6,530,432 | B1 * | 3/2003 | Gipson | 166/384 |
| 6,543,546 | B1 * | 4/2003 | Kaiser | 166/382 |
| 6,695,048 | B1 * | 2/2004 | Andersen et al. | 166/77.2 |

* cited by examiner

*Primary Examiner*—David Bagnell
*Assistant Examiner*—Shane Bomar
(74) *Attorney, Agent, or Firm*—John W. Wustenberg; McAfee & Taft

(57) ABSTRACT

A coiled tubing injector assembly includes a coiled tubing injector and a tubing guide. The tubing guide has an automatic clamping mechanism that includes a pair of clamping slips. The clamping slip will automatically move from an open position in which coiled tubing can pass through the clamping sips, to a closed position in which the clamping slips positively clamp the coiled tubing to the tubing guide. The clamping mechanism moves from the open to the closed position when the tubing guide is lifted from an installation platform in which the coiled tubing is positioned in the tubing guide so that it can be positioned on top of the coiled tubing injector. The clamping mechanism will automatically clamp the coiled tubing to the tubing guide when the tubing guide is removed from the coiled tubing injector.

22 Claims, 11 Drawing Sheets

TUBING GUIDE AND COILED TUBING INJECTOR

BACKGROUND

This invention relates to a coiled tubing injector assembly which comprises a gooseneck, which may also be referred to as a tubing guide, and a coiled tubing injector apparatus.

Reeled or coiled tubing has been run into completed wells for many years for performing certain downhole operations. Those operations include, but are not limited to, washing out sand bridges, circulating treating fluids, setting downhole tools, cleaning the internal walls of well pots, conducting producing fluids or lift gas, and a number of other similar remedial or production operations. The tubing utilized for such operations is generally inserted into the wellhead through a lubricator assembly or stuffing box. Typically, there is a pressure differential on the well so that the well is a closed chamber producing oil or gas or a mixture thereof from the pressurized well. The tubing that is inserted into the well is normally inserted through a lubricator mechanism which seals the well for pressure retention in the well.

The tubing is flexible and can bend around a radius of curvature and is normally supplied on a drum or reel. The tubing is pooled off the reel and inserted into a coiled tubing injector assembly. The coiled tubing injector assembly essentially comprises a curvilinear gooseneck, or tubing guide, and a coiled tubing injector apparatus positioned therebelow.

The curvilinear tubing guide forms an upper portion of the coiled injector assembly while the coiled tubing injector apparatus forms a lower portion thereof. Most coiled tubing injector apparatus utilize a pair of opposed drive chains arranged in a common plane. Such drive chains are made up of links, rollers, and gripper blocks. The drive chains are generally driven by sprockets powered by a motor which is a reversible hydraulic motor. The opposed drive chains grip the coiled tubing and are backed up by linear beams, also referred to as pressure beams, so that a number of pairs of opposed gripping blocks are in gripping engagement with the tubing at any given moment. Coiled tubing injector apparatus are shown in U.S. Pat. No. 6,209,634 to Avakov et al., U.S. Pat. No. 5,553,668 to council et al., U.S. Pat. No. 5,094,340 to Avakov, and U.S. Pat. No. 4,655,291 to Cox, all of which are incorporated herein by reference in their entirety. A tubing guide is shown in U.S. Pat. No. 5,799,731, the details of which are incorporated herein by reference in its entirety.

Typically, to insert the coiled tubing into the well, the coiled tubing is first spooled off of the reel and is placed on the tubing guide and inserted through a base of the tubing guide. The tubing guide will typically be placed on an installation platform such as a trailer when the tubing is installed therethrough. Once the coiled tubing is inserted through the base of the tubing guide, the coiled tubing must be manually clamped to the tubing guide. Typically, a clamp of a type known in the art is manually placed on the coiled tubing below the base of the tubing guide. Because the coiled tubing has been spooled from a reel, the residual stresses in the coiled tubing will try to pull the coiled tubing from the tubing guide. Once the coiled tubing is clamped, the tubing guide is lifted with a crane or other piece of equipment known in the art, and moved to the coiled tubing injector apparatus. If the coiled tubing is not clamped, the residual stresses in the coiled tubing will cause the coiled tubing to be released from the tubing guide, and the coiled tubing can whip in an uncontrolled fashion, which is extremely dangerous to personnel in the area. The tubing guide is placed over the coiled tubing injector apparatus and is lowered so that the length of coiled tubing extending through the base of the tubing guide can be engaged by the gripper chains in the coiled tubing injector apparatus. Once the coiled tubing is engaged by the gripper chains, the clamp must be manually removed by a worker who must reach between the base of the tubing guide and the coiled tubing injector apparatus prior to the time the tubing guide is placed directly on top of the coiled tubing injector apparatus. Once the clamp is removed, the tubing guide can be lowered completely so that it engages a coiled tubing injector frame of the coiled tubing injector apparatus.

The tubing guide has pins, referred to as base pins, extending downwardly from the tubing guide base. The base pins are received in legs of the coiled tubing injector frame. Once the tubing guide is placed in position on the frame, latch pins may be inserted through the legs of the injector frame into latch pin receptacles defined in the base pins, so that the tubing guide is latched or secured to the injector frame. The present manner of inserting a latch pin requires that a worker manually insert the latch pins which requires the worker to operate at or near the top of the injector frame. If it is desired to remove the latch pins, the latch pins must be manually removed.

Although the present manner of clamping the coiled tubing to the tubing guide and of latching the tubing guide to the injector frame works, there are inherent concerns with those methods. To remove the clamp, a worker must position his arm between the tubing guide and the injector frame which is being lowered onto the injector frame. The clamp is removed after a length of tubing has been engaged by the gripper chains. A clamp must also manually be placed on the tubing if it is desired to remove the tubing guide from the coiled tubing injector apparatus which also requires a worker to position his arm between the tubing guide and injector frame.

The latch pins must also be manually removed by an operator at or near the top of the coiled tubing injector frame. Thus, there is a need for an apparatus and method which will positively clamp coiled tubing to the tubing guide so that it will not be released from the tubing guide while the tubing guide is being moved from an installation platform to the coiled tubing injector frame or when it is removed from the coiled tubing injector frame. Likewise, there is a need for a method and apparatus which will allow the tubing guide to be latched to the coiled tubing injector frame and unlatched therefrom without the necessity of personnel manually installing and retracting latch pins at or near the top of the coiled tubing injector frame.

SUMMARY

The present invention is directed to a coiled tubing injector assembly comprising a tubing guide and a coiled tubing injector apparatus. The tubing guide includes a base, and has a carrier arm extending upwardly from the base. A pair of clamping slips may be disposed in the carrier arm. The clamping slips are movable between an open position wherein coiled tubing can pass through the clamping slips and through the base without being engaged by the clamping slips. The clamping slips are movable to a closed position in which the clamping slips will engage the coiled tubing and positively clamp the coiled tubing to the tubing guide so that the coiled tubing will not be released when the tubing guide is moved from an installation platform to the coiled tubing injector apparatus or is removed from the coiled tubing injector apparatus. The clamping slips are positioned between a pair of opposed side plates. The clamping slips will automatically move from the open to the closed position when the tubing guide is removed from the installation platform or when it is removed from the coiled tubing injector apparatus with the coiled tubing passing therethrough. The tubing guide includes an actuator linkage connected to the clamping slips for moving the clamping slips between the open and the closed positions. The clamping slips will automatically move from the closed position to the open position when the tubing guide is placed on top of the coiled tubing injector.

The clamping slips have a gripping surface defined on an upper face thereof. The upper ace is preferably sloped so that a height of the clamping slip decreases from the first end to the second end of the clamping slip. Likewise, the gripping surface, which preferably comprises a generally V-shaped gripping surface, has a height that decreases from a maximum height at the first end to a minimum height at the second end of the clamping slip. The clamping slips are directionally biased in the preferred embodiment so that the tubing may slip in one direction, but not the other. The slips are also contained within a grooved travel path that is formed in such a manner that the slips are directional in nature. When the slips are engaged upon the tubing, the slips clamp with more force when more tension is pulled on the tubing. This method is similar to a slip-bowl configuration commonly used in the oil field, but is comprised of a sloped travel path instead of a sloped bowl.

The coiled tubing injector frame of the present invention includes a latch mechanisms for securing the tubing guide to the coiled tubing injector frame. The coiled tubing injector frame is comprised of a plurality of vertical support legs extending upwardly from a coiled tubing injector platform. The latch mechanism comprises latch pins that are received in openings in the vertical support legs. The vertical support legs include a plunger disposed therein at or near an upper end thereof. The plunger is movable between an upper and a lower position in the vertical support legs. Base pins extending downwardly from the tubing guide will be received in the vertical support legs when the tubing guide is placed on the coiled tubing injector frame. The base pins will press the plungers to the lower position when the tubing guide is placed on the coiled tubing injector frame. The latch pins will be inserted into the base pins to latch the tubing guide to the coiled tubing injector frame. The latch pins preferably automatically extend into the base pins received in the vertical support legs when the base pins depress the plungers. The coiled tubing injector frame preferably includes four support legs each having a plunger therein. Thus, the coiled tubing injector frame preferably includes four latch pins each corresponding to, or operably associated with, a vertical support leg.

The latch pins are preferably urged into the base pins by spring-driven actuator linkages connected to the latch pins. The coiled tubing injector frame may therefore include two actuator linkages, a forward actuator linkage which will drive two forward latch pins and a rear actuator linkage which will urge or drive two rear latch pins.

BRIEF DESCRIPTION OF THE DRAWINGS

FIG. 9 is a left side view of the tubing guide of the present invention with clamping clips of the present invention engaging coiled tubing.

FIG. 13 is a perspective view of the tubing guide of the present invention showing the clamping slips disengaged so that the coiled tubing can pass through the tubing guide.

DETAILED DESCRIPTION OF A PREFERRED EMBODIMENT

Figure 1:
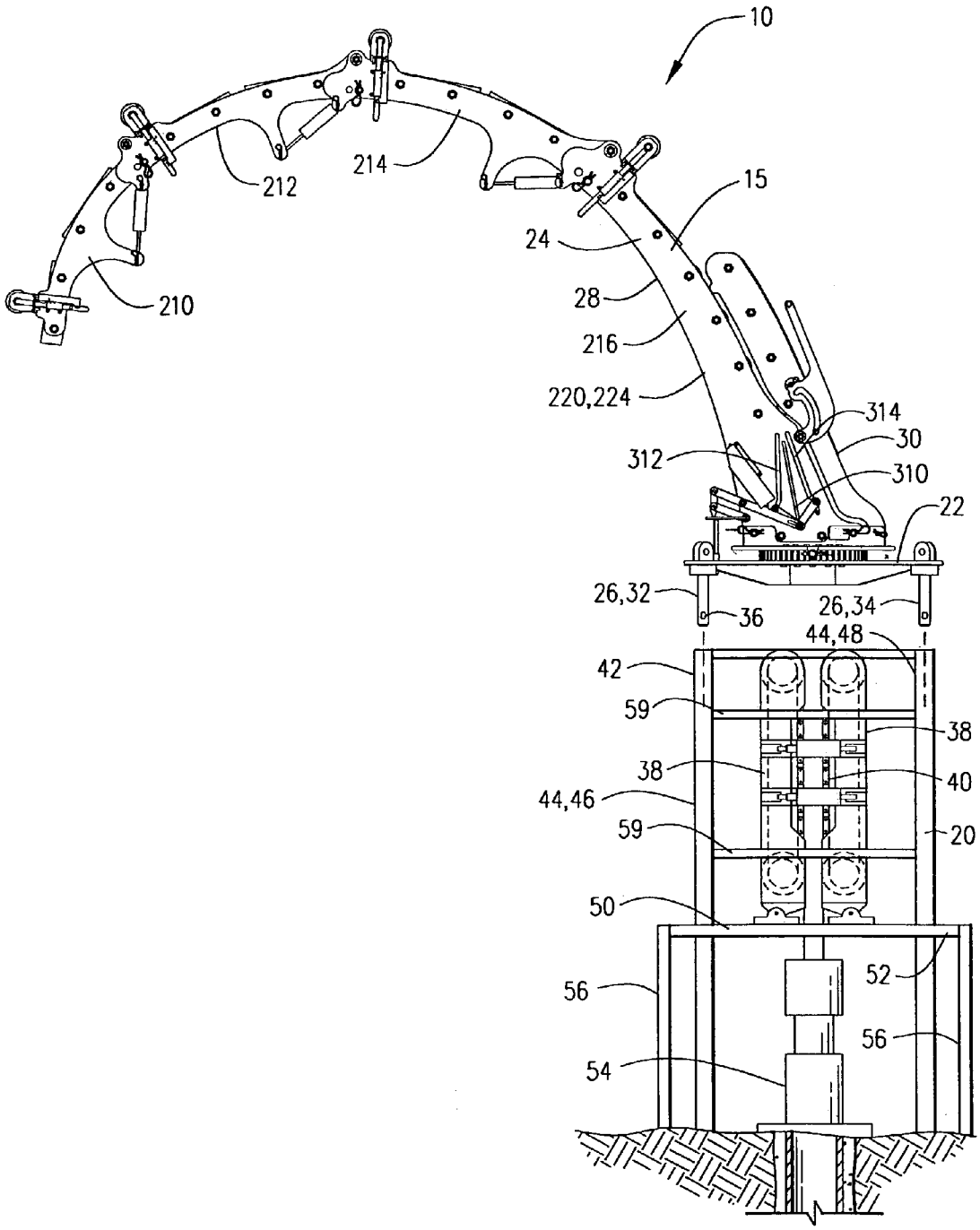
FIG. 1 is a right side view of a coiled tubing injector assembly of the present invention.

Referring now to the drawings, a coiled tubing injector assembly generally designated by the numeral 10 is shown. Coiled tubing injector assembly 10 will inject, suspend and withdraw coiled tubing 11 in a well 12. Well 12 may comprise a wellbore 13 having a casing 14 cemented therein. Coiled tubing injector assembly 10 may comprise a tubing guide or gooseneck 15 and a coiled tubing injector apparatus 20, which may be referred to simply as injector apparatus 20. Tubing guide 15 generally comprises a base 22 having a carrier arm 24 extending therefrom. Tubing guide 15 may be in accordance with any type of tubing guide known in the art having a base and a carrier arm. For example, base 22 and carried arm 24 may be in accordance with the tubing guide shown in U.S. patent application No. 09/801,365, assigned to the assignee of the present invention, the details of which are incorporated herein by reference in its entirety, or U.S. Pat. No. 5,799,731. Base 22 has a plurality, and preferably four tubing guide pins, or base pins 26. As viewed in FIG. 1, the direction to the left-hand side of the page may be referred to as the forward or front direction and the direction toward the right side of the page may be referred to as the rear or back direction so that the coiled tubing injector assembly 10 has a front or forward side 28 and a rear or back side 30. Base pins 26 may therefore comprise a pair of forward base pins 32 and a pair of rear base pins 34. All of the base pins 26 have openings 36 defined therethrough.

Openings 36 may be referred to herein as latch pin receptacles 36. The details of tubing guide 15 are described more fully hereinbelow.

Coiled tubing injector apparatus 20 of the present invention may comprise a pair of carriages 38 each having gripper chains 40 as schematically represented in FIG. 1. As is well known in the art, the gripper chains 40 will engage the coiled tubing 11. The carriages 38 and gripper chains 40 may be any type known in the art, such as, for example, those described in U.S. Pat. No. 6,209,634, assigned to the assignee of the present invention, and U.S. Pat. No. 5,094,340.

Coiled tubing injector apparatus 20 includes a coiled tubing injector frame 42 which may be referred to as injector frame 42 Coiled tubing injector frame 42 comprises a plurality of vertical support legs 44 which may comprise a pair of forward vertical support legs 46 and a pair of rear vertical support legs 48. Vertical support legs 44 may extend upwardly from an injector base 50. Likewise, carriages 38 may be connected to and may extend upwardly from injector base 50, which may be connected to and comprise pair of the injector frame 42. Injector base 50 may be attached to or may be a part of a coiled tubing injector platform 52 which is positioned over a wellhead 54 through which the coiled tubing 11 must pass prior to entering well 12. Coiled tubing injector platform 52 may be supported by legs 56 or other structure known in the art. Coiled tubing injector apparatus 20 may also be placed directly on top of the wellhead 54 with no platform at all. In other words, it is known in the art that the coiled tubing injector apparatus 20 can be supported above the wellhead 54 without coiled tubing injector platform 52, or legs 56 that extend below injector base 50.

Coiled tubing injector frame 42 may include horizontal supports 58 at the forward and rear sides 28 and 30 of the coiled tubing injector assembly 10 and may likewise include horizontal supports 59 along the side thereof.

When tubing guide 15 is placed on coiled tubing injector frame 42, base pins 26 are received in vertical support legs 44. With prior art assemblies, a latch pin was manually inserted through an opening in the vertical support legs 44 into latch pin receptacles 36.

Figure 2:
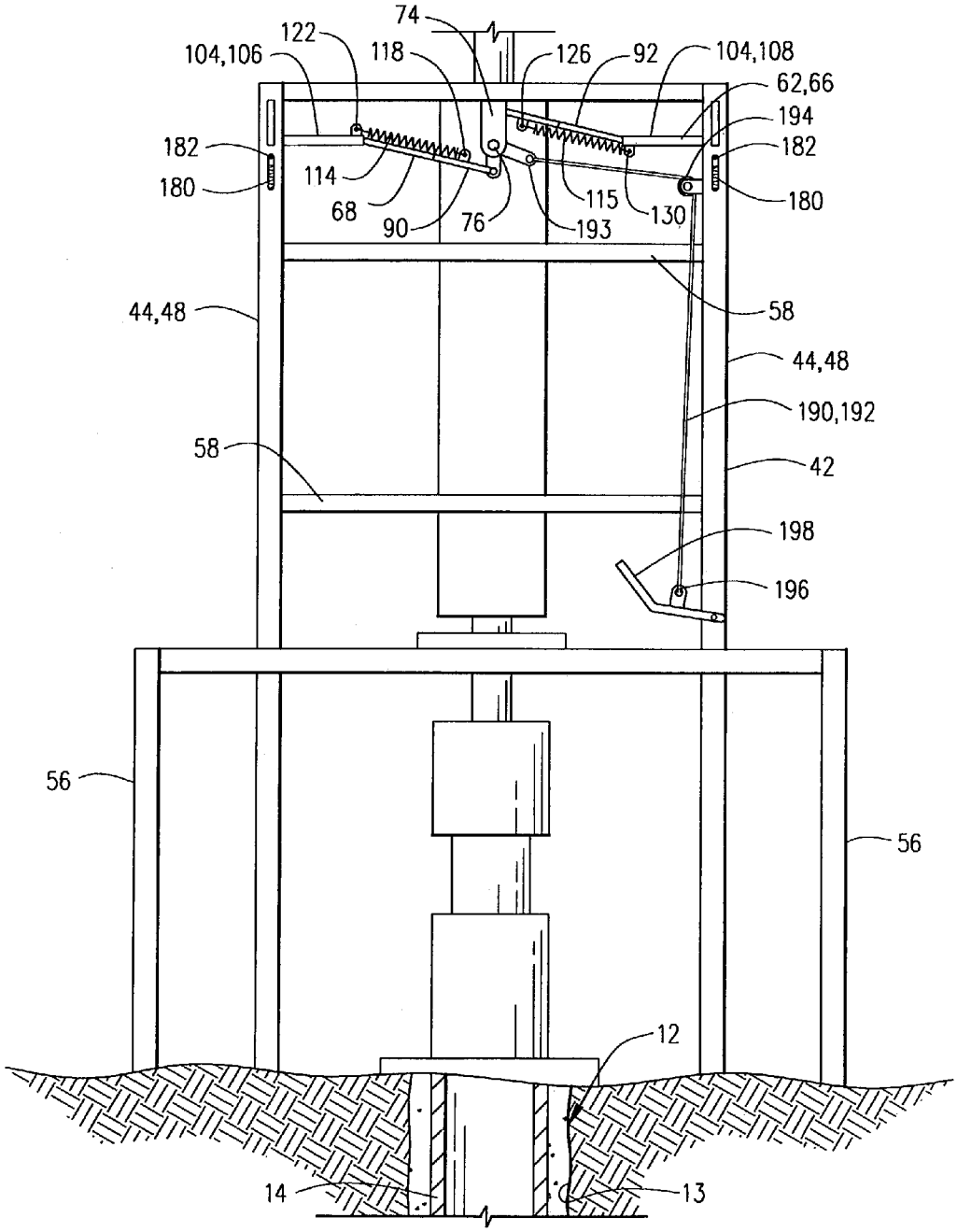
FIG. 2 is a rear view of a coiled tubing injector frame of the present invention positioned over a wellhead.
Figure 4:
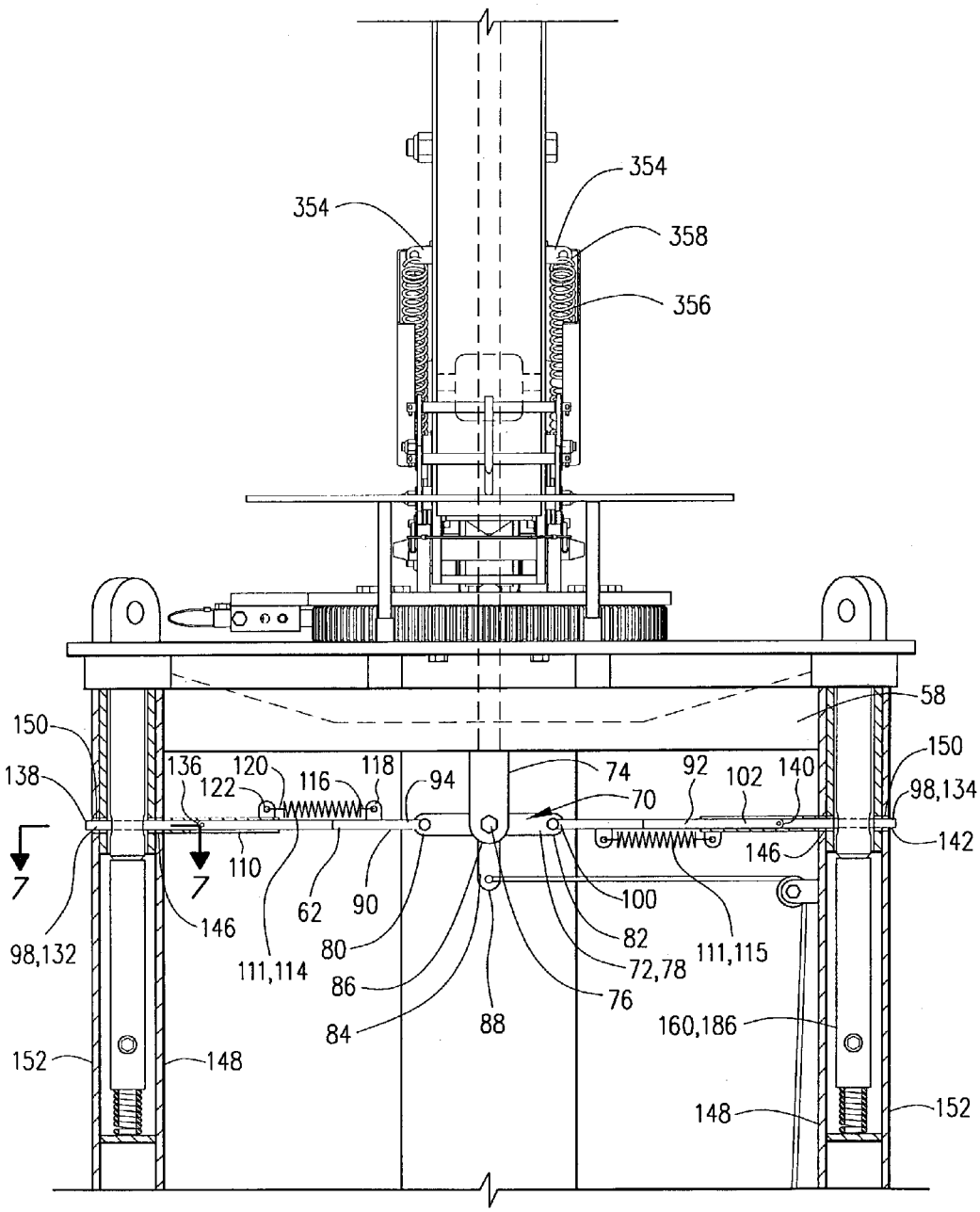
FIG. 4 is a view from the front showing the tubing guide of the present invention positioned on the coiled tubing injector frame. The legs of the coiled tubing injector frame are shown in cross-section.
Figure 5:
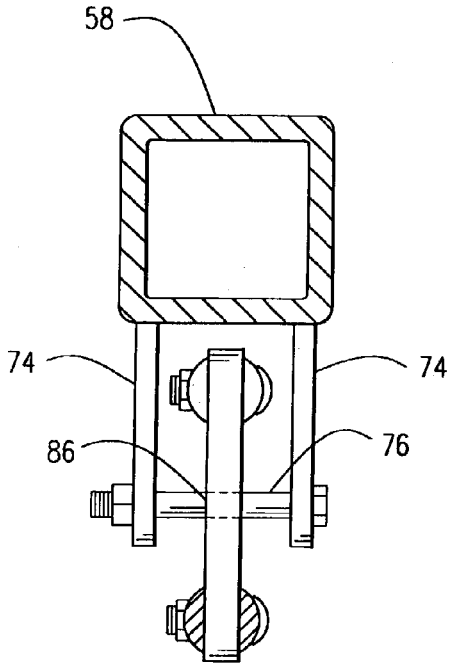
FIG. 5 is a view from line 5—5 of FIG. 3.
Figure 6:
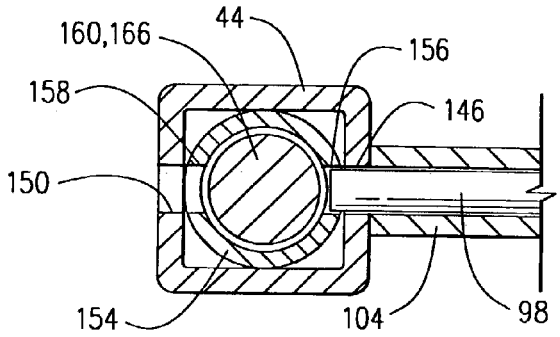
FIG. 6 is a view from line 6—6 of FIG. 3.
Figure 7:
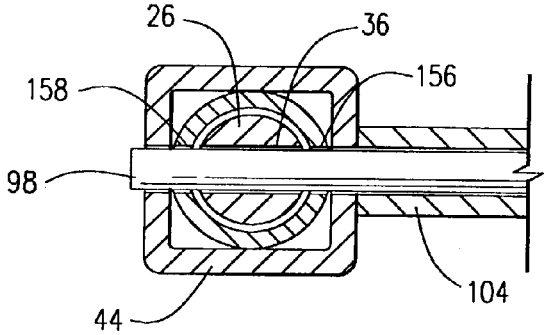
FIG. 7 is a view from line 7—7 of FIG. 4.
Figure 8:
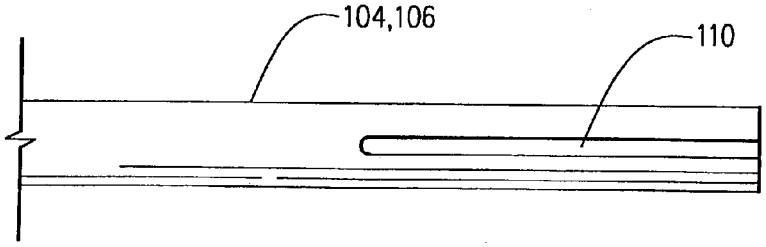
FIG. 8 is a view from line 8—8 of FIG. 3.
Figure 3:
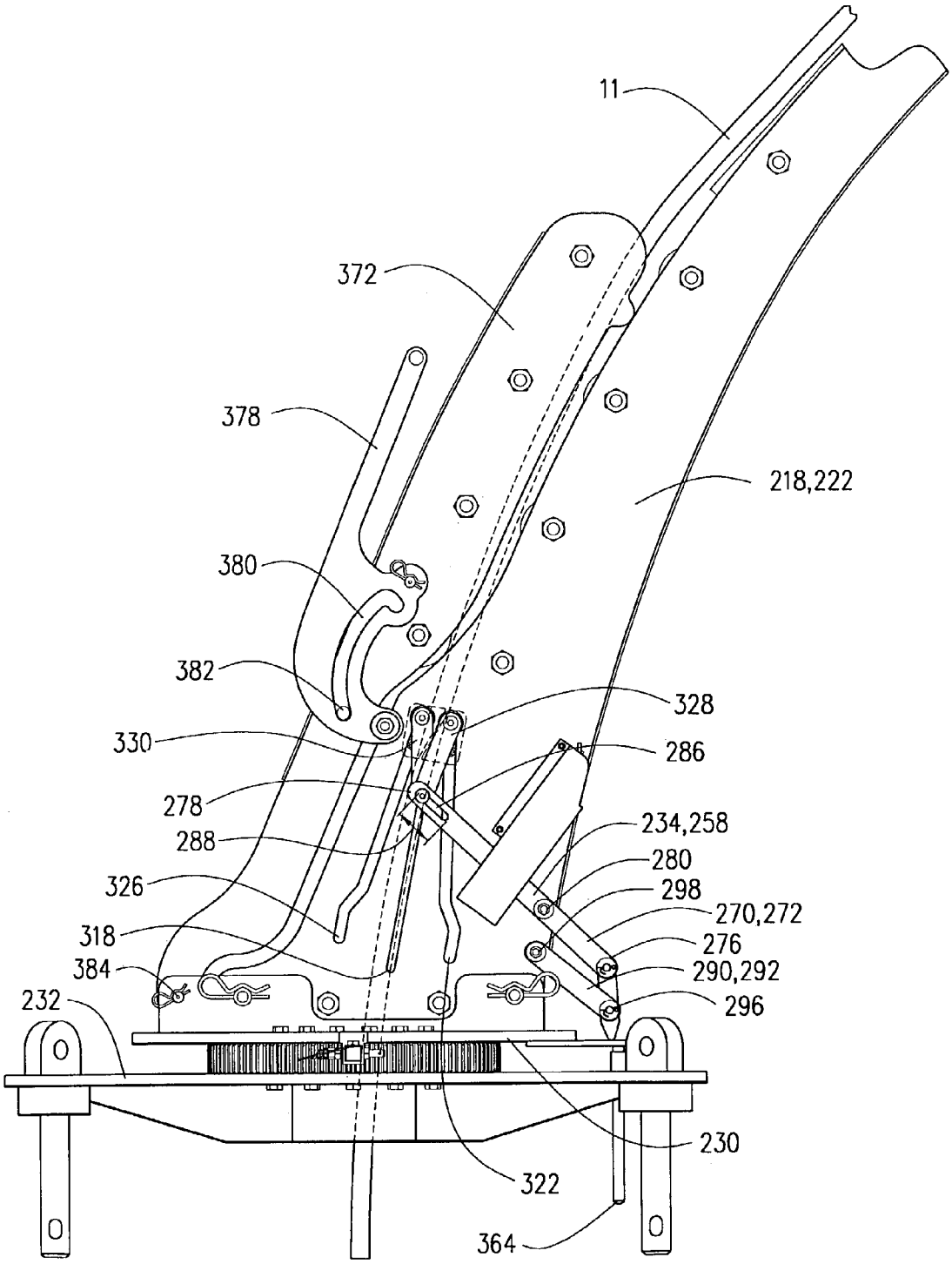

Coiled tubing injector apparatus 20 has automatic latching means 60, which comprises two automatic latching mechanisms 62. Automatic latching mechanisms 62 may comprise a forward automatic latching mechanism 64 and a rear automatic latching mechanism 66. Forward and rear latching mechanisms 64 and 66 are essentially identical and so the same numeric designations will be used to describe each. FIG. 2 shows automatic latching mechanism 62 in an unlatched or released position 68. FIG. 4 shows automatic latching mechanism 62 in a locked or latched position 70 in which tubing guide 15 is latched to coiled tubing injector frame 42. Automatic latching mechanisms 62 comprise an actuator linkage 72 pivotally connected to a lug 74 that is attached to and extends downwardly from the uppermost of the rear and forward horizontal supports 58. A pin 76 extends through lugs 74 and actuator linkage 72 pivots about pin 76.

Actuator linkage 72 comprises a center link 78 having a first end 80 and second end 82. A T-link 84 is connected to center link 78 at a mid-point 86 between the first and second ends 80 and 82 thereof. T-link 84 may be fixedly connected by any means known in the art or may be integrally attached or formed with center link 78. T-link 84 has a lower end 88.

Actuator linkage 72 has a first outer link 90 and a second outer link 92. First outer link 90 has a first end 94 and a second end 96. First end 94 is connected to center link 78 and second end 96 is connected to a latch pin 98.

Second outer link 92 has a first end 100 and a second end 102. First end 100 is connected to second end 82 of center link 78 and second end 102 is connected to a latch pin 98. As is apparent from the drawings, there are a total of four latch pins 98, two in the forward automatic latching mechanism 64 and two in the rear automatic latching mechanism 66. Thus, each latch pin 98 corresponds to or is operably associated with a vertical support leg 44. Each latch pin 98 is positioned in a shield 104. Shields 104 may comprise a first shield 106 and a second shield 108. First shield 106 has a slot 110 while second shield 108 has a slot 112. Slots 110 and 112 allow for the movement of first and second outer links 90 and 92 between the unlatched or released position 68 and the latched or locked position 70.

Automatic latching mechanisms 62 include a pair of actuating springs 111 which may be referred to as first actuating spring 114 and second actuating spring 115. First actuating spring 114 is attached at a first end 116 to a lug 118 that is fixedly connected to first outer link 90. A second end 120 of first actuating spring 114 is connected to a lug 122 that is fixed to first shield 106. Second actuating spring 115 has a first end 124 that is attached to a lug 126 which is fixedly connected to second outer link 92. Second actuating spring 115 has a second end 128 connected to a lug 130 that is fixedly connected to second shield 108. Latch pins 98 may be referred to as first latch pin 132 and second latch pin 134. First latch pin 312 has a first end 136 connected to second end 96 of first outer link 90, and has a second end 138. Second latch pin 134 has a first end 140 and a second end 142. First end 140 is connected to second end 102 of second outer link 92.

Each of the vertical support legs 44 has an opening 146 in which the second ends 138 and 142 of first and second latch pins 132 and 134 are received. The opening 146 is defined on an inner side 148 of each of vertical support legs 44. Each vertical support leg 44 has an opening 150 on an outer side 152 of each of vertical support legs 44. Opening 150 is coaxial with opening 146 and thus is aligned with opening 146. Each vertical support leg 44 has a sleeve 154 fixedly attached therein. The sleeve 154 is positioned at or near the upper ends of vertical support legs 44.

Each sleeve 154 has a pair of coaxial holes 156 and 158, respectively, for receiving latch pins 98. Hole 156 is adjacent the inner side 148 of vertical support leg 44 and hole 158 is adjacent the outer side 152 thereof. A plunger 160 is received in sleeve 154 and prevents the insertion of latch pins 98 through their corresponding vertical support legs 44. Plungers 160 have an upper end 162 and a lower end 164, and are comprised of an upper portion 166 which is preferably a solid portion and a lower portion 168 that is preferably a hollow lower portion 168 and thus defines a cylindrical shape. A spring 170 having an upper end 172 and a lower end 174 is disposed in each of vertical support legs 44. Spring 170 is attached at its lower end 174 to a spring mount 176 that is fixed to vertical support leg 44. Upper end 172 of spring 170 is received in hollow lower portion 168 of plunger 160. A pin 178 extends through hollow lower portion 168 of plunger 160. Pin 178 travels in parallel slots 180 defined in vertical support legs 44. Parallel slots 180 have an upper end 182.

Figure 3:
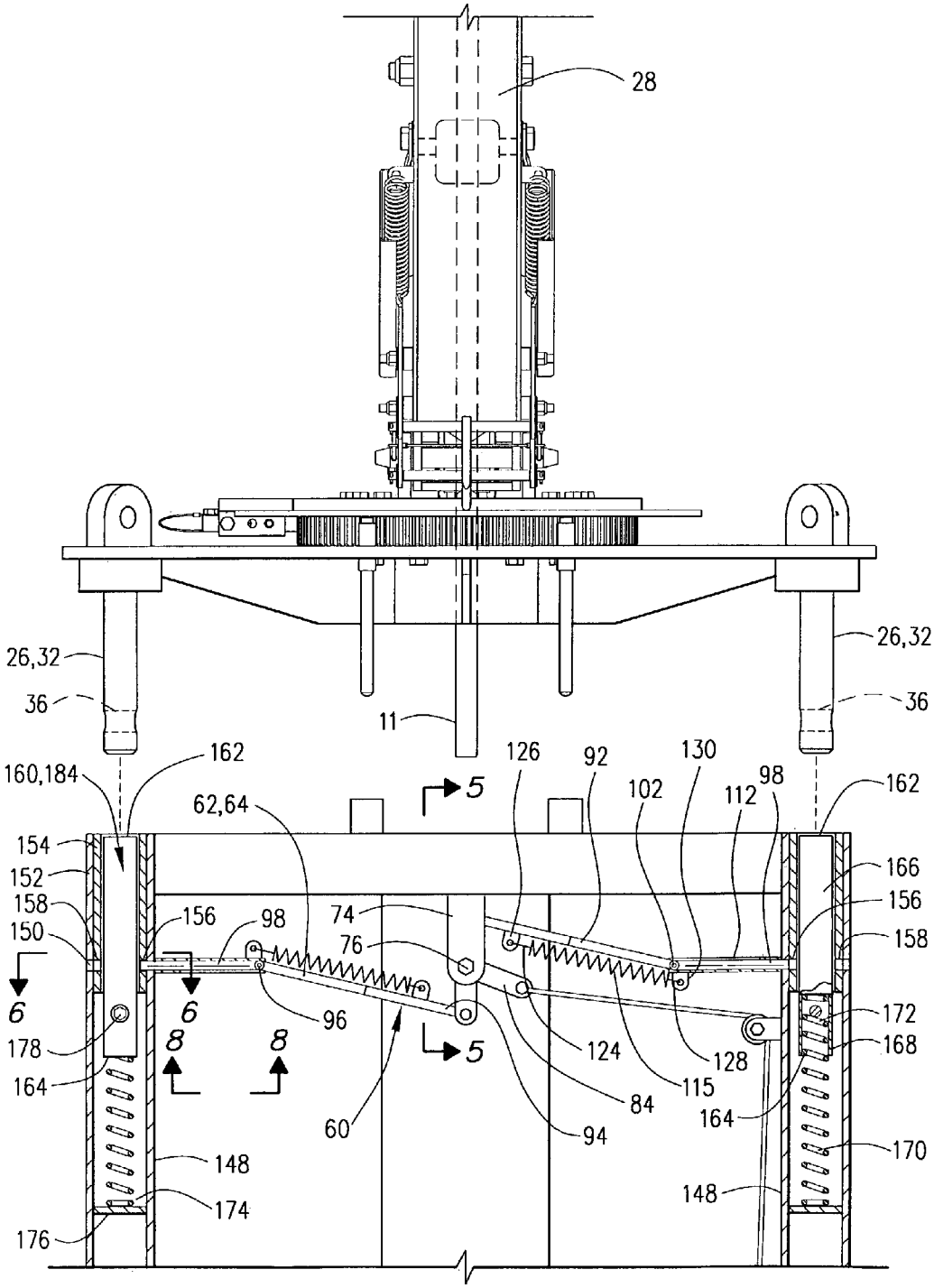
FIG. 3 is a view from the front showing a tubing guide of the present invention positioned over the coiled tubing injector frame prior to the time the tubing guide is positioned on the coiled tubing injector frame. The legs of the coiled tubing injector frame are shown in cross-section.

FIG. 3 shows tubing guide 15 positioned above coiled tubing injector frame 42 prior to the time base pins 26 have been received in vertical support legs 44. Vertical support legs 44 are shown in partial cross-section. Actuator linkages 72 are therefore in the unlatched or released position 68. In the unlatched position 68 of the actuator linkages 72, plungers 160 are urged upwardly by springs 170 to cover openings 146 and 150 in vertical support legs 44 and holes 156 and 158 in sleeve 154 which prevents latch pins 98 from being inserted into their corresponding vertical support legs 44. This position may be referred to as the upper position 184 of plungers 160. Pins 178 will engage upper end 182 of slots 180 to prevent plungers 160 from being urged out of the vertical support legs 44 by springs 170.

FIG. 4 shows plunger 160 in their lower position 186 which corresponds to the latched position 70 of actuator linkages 72. When tubing guide 15 is being mounted on coiled tubing injector frame 42 and the base pins 26 are received in vertical support legs 44, base pins 26 will engage the upper end 162 of plungers 160 and will urge plungers 160 downwardly to lower position 186. When tubing guide 15 is positioned on coiled tubing injector frame 42, latch pin receptacles 36 will align with openings 146 and 150 and holes 156 and 158. First and second actuating springs 114 and 115 will cause center link 78 to rotate which will urge first and second outer links 90 and 92 outwardly. First and second outer links 90 and 92 will urge latch pins 98 through openings 146 in vertical support legs 44 and through latch pin receptacles 36 in base pins 26. Thus, latch pins 98 will be inserted through openings 146 and 150, latch pin receptacle 36 and holes 156 and 158 to automatically latch tubing guide 15 to coiled tubing injector frame 42. Each latch pin 98 is inserted through its corresponding vertical support leg 44 so that in the embodiment shown, four latch pins 98 are inserted through the four vertical support legs 44 and into the latch pin receptacles 36 in the base pins 26.

An automatic release means 190 is also included. Automatic release means 190 includes a release cable 192 connected to the lower end 88 of T-link 84. Release cable 192 can be positioned around a pulley 194 that is attached to a vertical support leg 44. A second end 196 of release cable 192 may be attached to a handle 198 that is pivotally connected to the vertical support leg 44. Release cable 192 has a length sufficient such that second end 196 thereof, or handle 198 that is attached to second end 196, may be grasped or manipulated from a position well below latch pins 98 such as a ground surface or other platform on which an operator can stand, such as coiled tubing injector platform 52. Both forward and rear automatic latching mechanisms 64 and 66 have an automatic release means 190, so that both can be moved to the unlatched or released position 68 by pulling downward on the second end 196 of release cable 192 with handle 198 or other means, which will cause T-link 84 to rotate and thus center link 78 to rotate as well. The rotation of center link 78 will cause latch pins 98 to retract from latch pin receptacles 36 in vertical support legs 44, thus freeing base pins 26 for upward movement. The tubing guide 15 can be moved upwardly and removed from coiled tubing injector frame 42. Springs 170 will urge plungers 160 upwardly, so that handle 198 can be released, and the latch pins 98 will be prevented from passing through vertical support legs 44 by plungers 160. Thus, the present invention includes an apparatus and method for automatically latching tubing guide 15 to coiled tubing injector frame 42, and for releasing tubing guide 15 from coiled tubing injector frame 42 from a platform positioned below tubing guide 15 such as, for example, a platform or the ground surface. Dangers associated with the conventional manner of latching and unlatching tubing guide 15 to the coiled tubing injector frame 42 are eliminated since it is not necessary for an operator or worker to manually insert and retract latch pins from atop the coiled tubing injector frame 42 as is the case in the prior art.

Tubing guide 15 of the present invention may be a segmented tubing guide like that shown in U.S. patent application No. 09/801,365. Tubing guide 15 may thus be a segmented tubing guide including upper segments 210, two intermediate segments 212 and 214, respectively, and a lower segment 216 which may be referred to as a base segment 216. Carrier arm 24 may be referred to as a primary carrier arm and includes left and right side plates 218 and 220, respectively. While tubing guide 15 may be segmented, non-segmented tubing guides having carrier arms with opposed side plates may be used, and the present invention is not limited to segmented tubing guides. Left and right side plates 218 and 220 are preferably segmented side plates and thus include left and right lower side plates 222 and 224, respectively. A plurality of tubing supports 226 are positioned between left and right side plates 218 and 220 and are connected thereto in a means known in the art. Tubing supports 226 are preferably comprised of wear blocks which have a V-groove in the upper surface thereof to define a tubing support surface 228.

Base 22 of tubing guide 15 may comprise an upper base portion 230 rotatably attached to a lower base portion 232. Base pins 26 extend downwardly from lower base portion 232 and as explained hereinabove may be utilized to attach tubing guide 15 to coiled tubing injector apparatus 20. An automatic clamping device, or automatic clamping apparatus 234 will automatically clamp coiled tubing 11 to tubing guide 15. Automatic clamping device 234 comprises a pair of clamping slips or clamping blocks 236.

Clamping slips 236 are shown in FIGS. 14–18 and have sides 237, a first end 238, a second end 240, an upper face 242 and a lower face 244. A gripping surface 246 is defined on upper face 242. Clamping slips 236 having a plurality of openings 247 in the sides 237 thereof for receiving pins as will be described in more detail hereinbelow. Gripping surface 246 is generally V-shaped, and comprise a plurality of ridges and furrows 248 and 250, respectively, to define gripping teeth 252. First end 238 has a height 254, and second end 240 has a height 256 which is less than height 254. Upper face 242 thus slopes downwardly from first end 238 to second end 240 so that gripping surface 246 is a sloped gripping surface.

Figure 10:
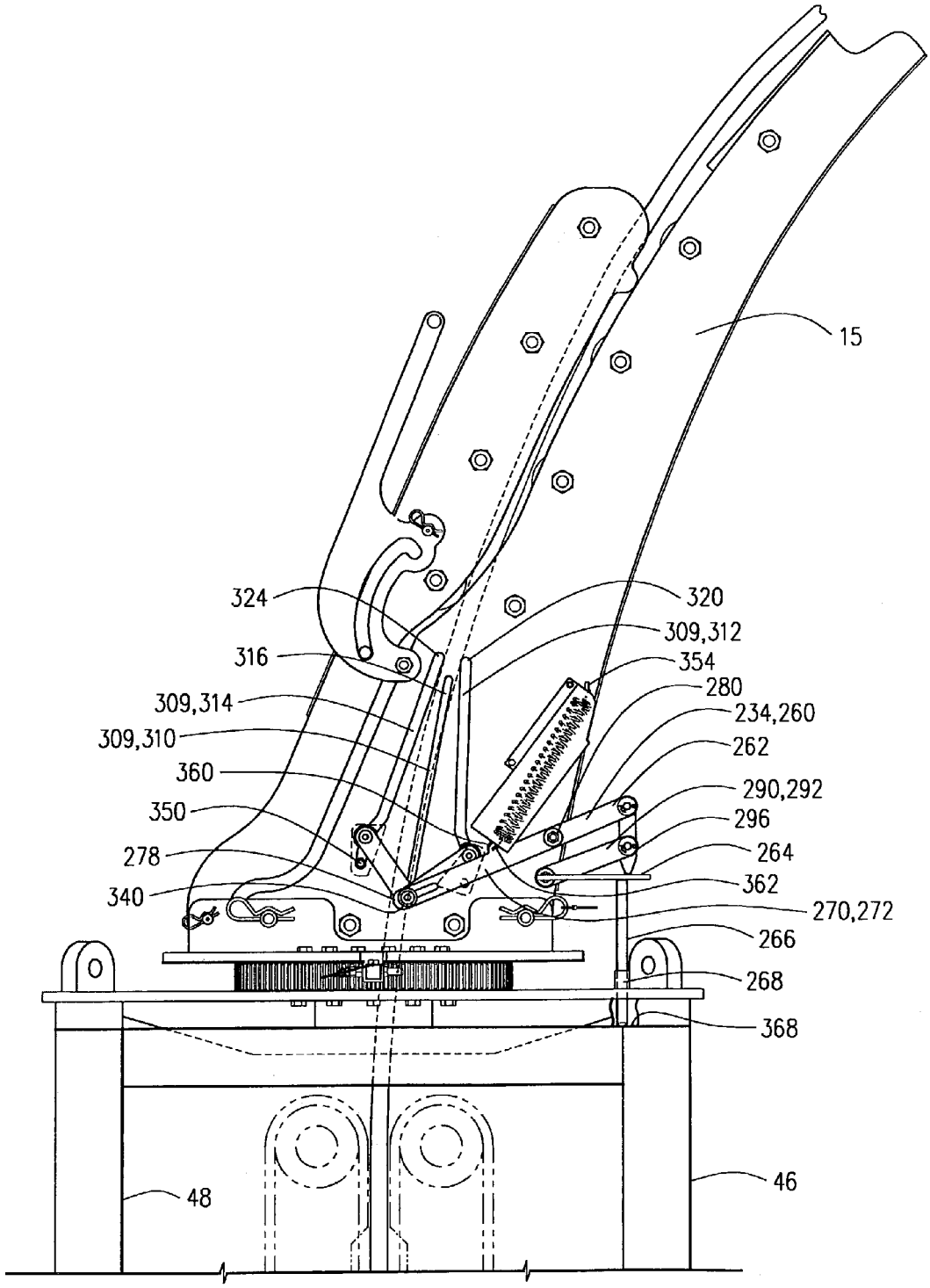
FIG. 10 is a left side view of the coiled tubing injector assembly with the clamping slips of the present invention disengaging the coiled tubing while the tubing guide is positioned on the coiled tubing injector apparatus.
Figure 11:
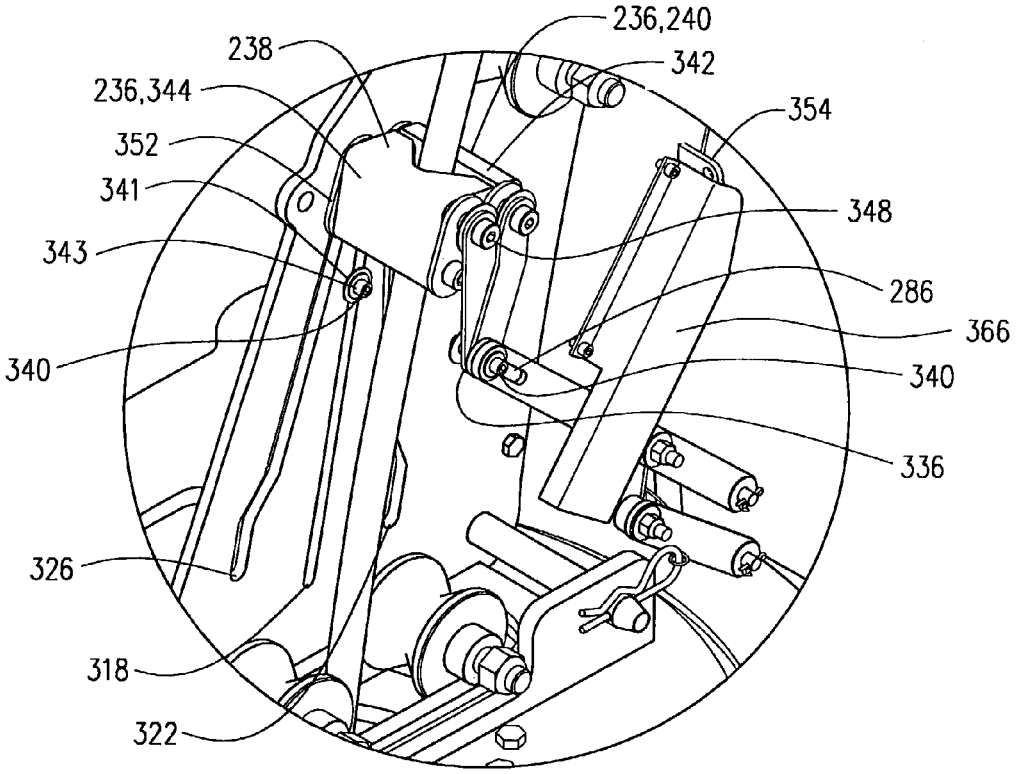
FIG. 11 is a perspective view with a side plate removed showing the clamping slips of the tubing guide engaged.
Figure 12:
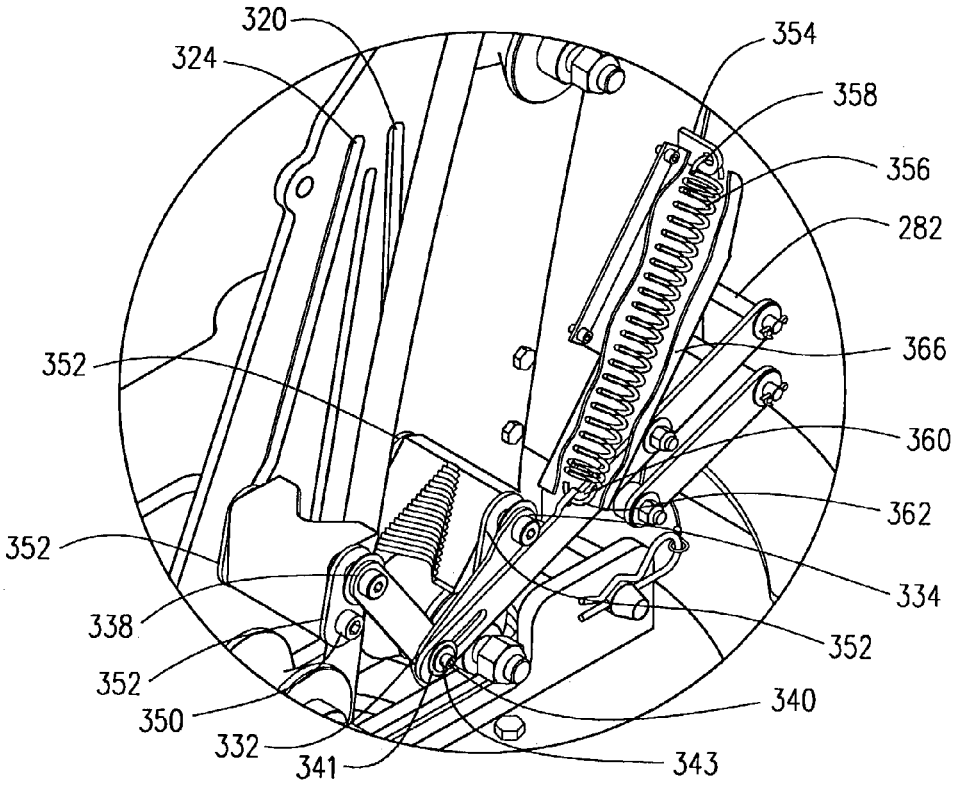
FIG. 12 is a perspective view with a side plate removed showing the clamping slips disengaged.
Figure 7E:
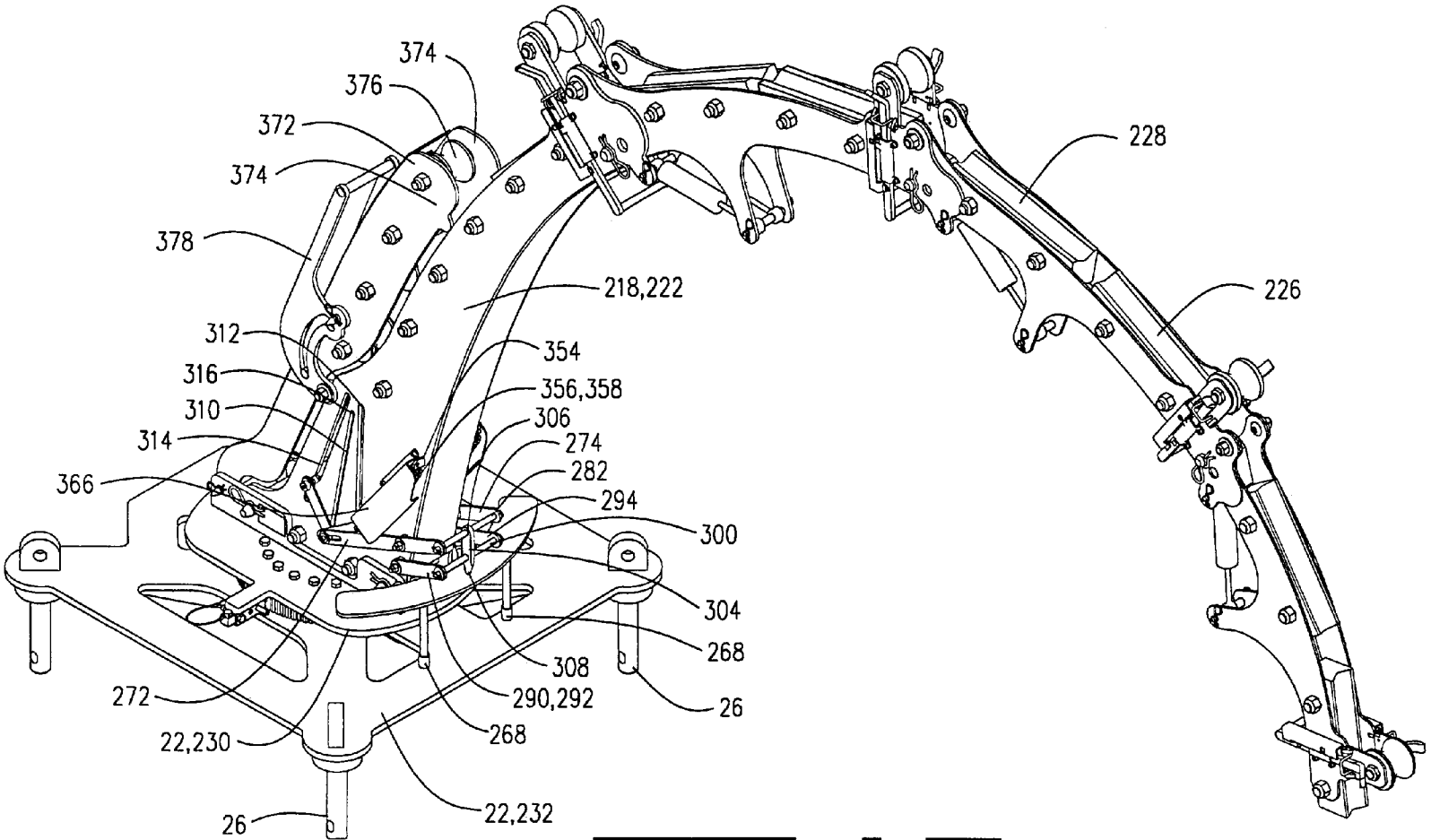
Figure 14:
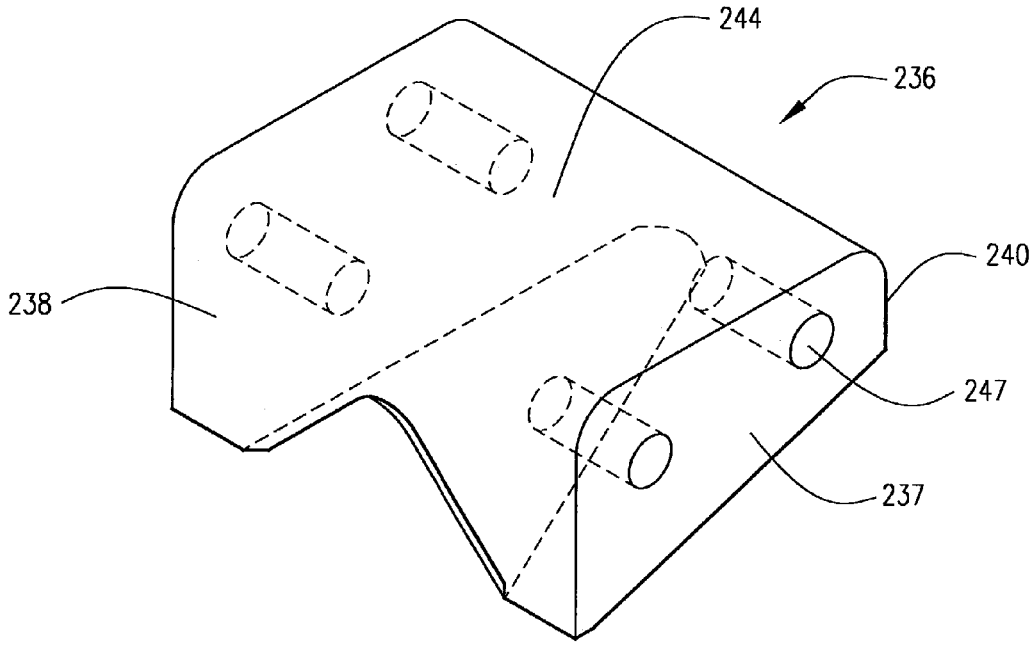
FIGS. 14 and 15 are perspective views of a clamping slip of the present invention.
Figure 15:
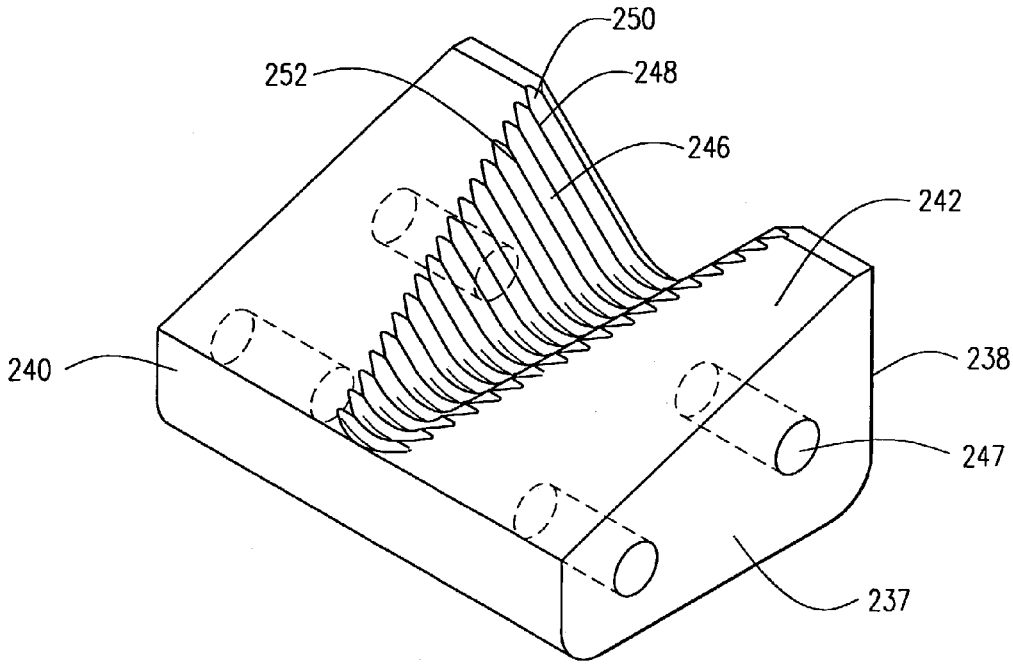
Figure 16:
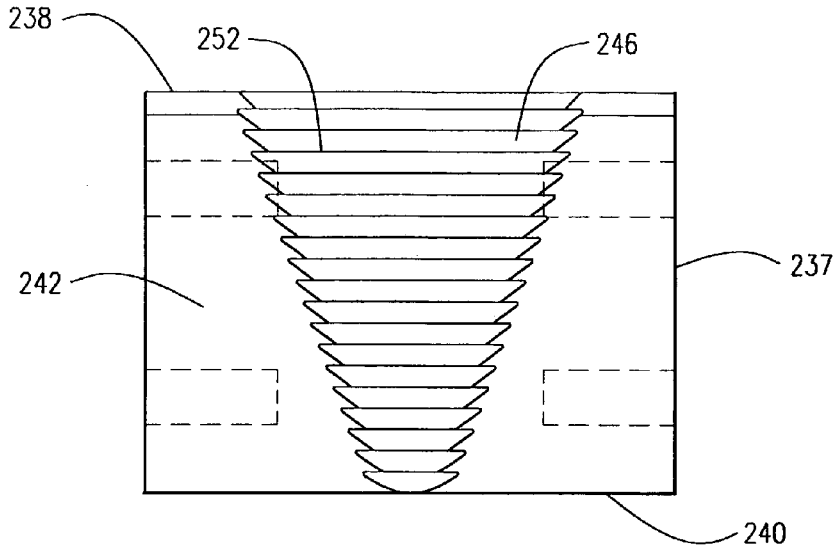
FIG. 16 is a top view of the clamping slip of the present invention.
Figure 17:
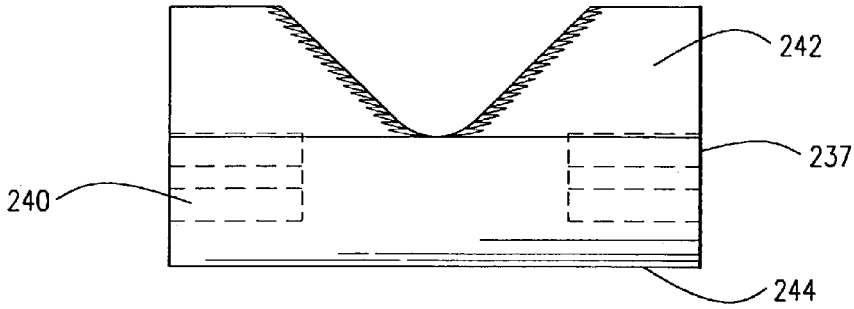
FIG. 17 is a rear end view of the clamping slip of the present invention.
Figure 18:
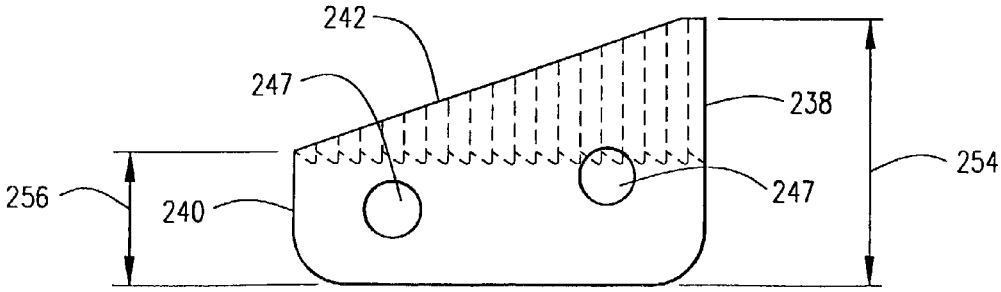
FIG. 18 is a side elevation view of the clamping slip of the present invention.

By utilizing clamping slips 236 with a sloped gripping surface 246, the range of diameters of coiled tubing 11 that may be utilized with automatic clamping apparatus 234 of the present invention is greater than would be capable with clamping slips or clamping blocks utilizing a flat upper face that defines a gripping surface of constant height. As is understood in the art, the range in diameters which can be adequately gripped between clamping blocks having a constant-height, V-shaped gripping surface and flat upper faces is approximately two times the smallest diameter that can be gripped by the clamping blocks. In other words, if the diameter of the smallest tubing that can be adequately gripped by a clamping block is X, the maximum diameter that can be adequately gripped is 2X. With clamping slips 236 of the present configuration, however, the clamping slips 236 can effectively grip and hold coiled tubing 11 having three times the diameter of the smallest diameter that can be adequately gripped. FIGS. 9 and 11 show automatic clamping device 234 and thus clamping slips 236 in a closed or clamping position 258. FIGS. 10 and 12 show automatic clamping apparatus 234 and thus the clamping slips 236 in an open position 260. In the open position 260, coiled tubing 11 can freely pass between clamping slips 236 into coiled tubing injector apparatus 20. As is apparent from the drawings, when coiled tubing injector assembly 10 is positioned on a loading or installation platform for the purpose of placing coiled tubing 11 on the tubing guide 15, or when the tubing guide 15 is positioned on coiled tubing injector apparatus 20, automatic clamping apparatus 234 is in its open position 260 so that coiled tubing 11 may pass freely therethrough. When tubing guide 15 is removed from an installation platform, or from coiled tubing injector apparatus 20 for the purpose of moving tubing guide 15 with the coiled tubing 11 therein, the automatic clamping apparatus 234 automatically moves to its closed position 258 and clamps coiled tubing 11 to prevent coiled tubing 11 from separating itself from tubing guide 15.

Automatic clamping apparatus 234 includes an actuator linkage 262, an actuator platform 264, and an actuator pin 266. Lower base portion 232 may include a pair of actuator pin guides 268 extending upwardly therefrom. Actuator pins 266 will be received in actuator pin guides 268 and may pass through an opening in lower base portion 232.

Actuator linkage 262 comprises a pair of biased, preferably parallel upper links 270. Upper links 270 comprise a left upper 272 and a right upper link 274. Left and right upper links 272 and 274 are preferably identical and so the same identifying numerals will be utilized for each. Upper links 270 have first end 276 and second end 278. Upper links 270 are pivotally connected to the side plates 218 and 220 so that left upper link 272 is pivotally connected to left lower side plate 222 and right upper link 274 is connected to right lower side plate 224. The left and right upper links 272 and 274 are pivotally connected using pins 280, bolts, or other known connections. An upper connecting rod 282 extends between the first ends 276 of the left and right upper links 272 and 274. Each of left and right upper links 272 and 274 has a slot 286 positioned near the second ends 278 thereof. Slot 286 has a length 288. Upper connecting rod 282 is rotatably received in both left and right upper links 272 and 274. Upper connecting rod 282 extends through left and right upper links 272 and 274 and may be held in place by cotter pins or other means known in the art.

Actuator linkage 262 further comprises a pair of lower links 290 which may be referred to as left and right lower links 292 and 294, respectively. Lower links 290 have first ends 296 and second ends 298. The second end 298 of left lower link 292 is pivotally connected to left lower side plate 222. Likewise, right lower link 294 is pivotally connected to right lower side plate 224. A lower connecting rod 300 extends between left and right lower links 292 and 294, respectively, and is pivotally connected to each. Lower connecting rod 300 is held in place with cotter pins or other means known in the art.

A center pin, or drive pin 304 having an upper end 306 and a lower end 308 is disposed between left and right upper links 272 and 274 and between left and right lower links 292 and 294, respectively. Upper and lower connecting rods 282 and 300 are received in openings defined in drive pin 304 and may be rotatably positioned therein. Lower end 308 of drive pin 304 engages actuator platform 264 so that, as will be described in more detail hereinbelow, up-and-down movement of actuator platform 264 causes up-and-down movement of the first ends 276 and 296 of upper and lower links 270 and 290, respectively.

Left and right lower side plates 222 and 224 each have actuator slots 309 defined therethrough, comprising a center actuator slot 310, a forward actuator slot 312 and a rear actuator slot 314. Center actuator slot 310 has upper end 316 and lower end 318. Forward actuator slot 312 has upper end 320 and lower end 322. Rear actuator slot 314 has upper end 324 and lower end 326. Forward and rear actuator slots 312 and 314 diverge outwardly from the upper ends 320 and 324 thereof to the lower ends 322 and 326 thereof, respectively. Center, forward, and rear actuator slots 310, 312 and 314 may also be referred to as center, forward, and rear guide slots 310, 312 and 314.

Actuator linkage 262 further includes first and second clamping links 328 and 330, respectively, at both of the left and right sides of tubing guide 15. First clamping link 328 has first end 332 and second end 334. Second clamping link 330 has first end 336 and second end 338. A pin 340 extends through slots 286 in both of left and right upper links 272 and 274 and through the first ends 332 and 336 of first and second clamping links 328 and 330. Pin 340 pivotally connects the left and right upper links 272 and 274 to first and second clamping links 328 and 330. Pin 340 will extend through center actuator slot 310 in each of left and right lower side plates 222 and 224 as better seen in FIG. 11. Washers 341 may be positioned inside the left and right lower side plates 222 and 224, and on an outer side of upper links 270. Nuts 343 or other connecting means may hold pin 340 in place. It is understood that any type of pin connection that will allow sliding and rotational movement may be used.

As is better seen in FIGS. 11 and 12, automatic clamping device 234 includes two clamping slips 236. For ease of reference, the two clamping slips 236 will be referred to as a forward clamping slip 342 and a rear clamping slip 344. Rear clamping slip 344 is positioned so that the first end 238 faces generally upwardly. Forward clamping slip 342 will be positioned so that the second end 240 thereof faces generally upwardly. Thus, forward and rear clamping slips 342 and 344 are opposed and are rotated 180° positionally in tubing guide 15, so that the first ends 238 of the clamping slips 236 are positioned opposite from one another. Openings 247 in clamping slips 236 are adapted to receive pins or other connectors known in the art. Openings 247 are defined in both of the sides 237 of clamping slips 236. As positioned in tubing guide 15, pins 348 extend through the second ends 334 and 338 of first and second clamping links 328 and 330 into the uppermost of openings 247 on forward and rear clamping slips 342 and 344, respectively. A blot or other connector 350 is received in the lowermost of openings 247 and connects a bearing washer 352 to sides 237 of clamping slips 236. Bearing washers 352 are positioned between clamping slips 236 and left and right lower side plates 222 and 234.

Pins 348 extend through left and right lower side plates 222 and 224, respectively, and are received in forward and rear actuator slops 312 and 314, respectively. The heads of the bolts, pins or other connectors 350 are received in and will travel in forward and rear actuator slots 312 and 314. A lug 354 is welded or otherwise connected to both of left and right lower side plates 222 and 224. A spring 356 is connected to lug 354 at a first end 358 thereof and is connected to a lug 360 defined on both of left and right upper links 272 and 274 at a second end 362 thereof. Springs 356 urge lugs 360 to cause upper links 270 to pivot about pin 280, which will pins 340 upwardly in center actuator slots 310. The upward movement will cause second ends 334 and 338 of first and second clamping links 328 and 330 to move upwardly and to converge so that forward and rear clamping slips 342 and 344 will converge and will clamp around coiled tubing 11. A shield 366 may be attached to left and right lower side plates 222 and 224 to cover springs 356.

Forward and rear slots 312 and 314 are designed to act like a slip bowl or biased slip as known in the art. Such a profile will create a tighter grip on coiled tubing 11 when it is pulled on, or tries to move upwardly out of the tubing guide 15. The profile will allow the coiled tubing 11 to move into (or downward) while not allowing the coiled tubing 11 (by virtue of additional grip) to move out (or upward). As is apparent from the drawings, the clamping slips 236 are located on the pivoting portion of tubing guide 15, i.e., above the pivoting bearing. This allows coiled tubing 11 to be gripped while allowing bsae 22 to rotate independently of coiled tubing 11. This allows the alignment of base pins 26 and sleeves 154 between injector frame 42 and tubing guide 15 while at the same time having coiled tubing 11 secured.

The operation of the invention is apparent from the drawings. When tubing guide 15 is positioned on an installation platform or on coiled tubing apparatus 20, lower ends 364 of actuator pins 266 will engage a surface on the installation platform which may be a plate or other structure or a surface 368 at the upper end of coiled tubing injector 20. As tubing guide 15 is lowered, actuator pins 266 will be forced upwardly, which will urge actuator platform 264 upwardly. Actuator platform 264 drives center pins 304 upwardly to hold actuator linkage 262 in the open position as is shown in FIG. 13 and in FIGS. 10 and 12 so that coiled tubing 11 can freely pass between forward and rear clamping slips 342 and 344. Coiled tubing injector 20 may thus inject, retract, or suspend the coiled tubing 11 as necessary. When tubing guide 15 is lifted so that it can be moved from the installation platform to the coiled tubing injector apparatus 20, or is removed from coiled tubing injector apparatus 20, actuator pins 266 are disengaged from the structure that forces actuator pins 266 upwardly, and thus actuator platform 264 upwardly. Springs 356 will cause upper links 270 to pivot about pins 280, and as described hereinabove, will move forward and rear clamping slips 342 and 344 upwardly in converging forward and rear actuator slots 312 and 314 so that forward and rear clamping slips 342 and 344 will converge and clamp coiled tubing 11. Thus, the actuator linkage 262 automatically clamps the coiled tubing 11 so that once tubing guide 15 is removed from an installation platform or from coiled tubing injector apparatus 20, the coiled tubing 11 cannot be released. If the residual or applied stresses (extra tension created by the reel) in the coiled tubing 11 try to move the coiled tubing 11 out of tubing guide 15, the forces will cause the clamping slips 236 to clamp tighter to coiled tubing 11. When tubing guide 15 is placed on coiled tubing injector apparatus 20, a sufficient amount of coiled tubing 11 will extend below tubing guide 15 so that it can be inserted between carriages 38 in coiled tubing injector apparatus 20 as is known in the art. The carriages 38 will hold coiled tubing 11 as the tubing guide 15 is then placed directly on coiled tubing injector frame 42. When tubing guide 15 is resting upon coiled tubing injector apparatus 20, actuator pins 266 will urge actuator platform 264 upwardly which through the action of drive pin 304 will cause upper links 270 to pivot and move the second ends 278 thereof downwardly, also causing first and second clamping links 328 and 330 to move downwardly so that forward and rear clamping slips 342 and 344 will diverge and allow coiled tubing 11 to be injected.

When tubing guide 15 is positioned atop coiled tubing injector apparatus 20, latch pins 98 will automatically be received in latch pin receptacles 36 as is described above. Thus, the tubing guide 15 will be latched to coiled tubing injector frame 42. If it is desired to remove tubing guide 15 from coiled tubing injector apparatus 20, seconds ends 196 of release cables 192 for both the forward and rear automatic latching mechanisms 64 and 66 can be pulled so that all of latch pins 98 are removed from latch pin receptacles 36 in base pins 26. Tubing guide 15 can then be lifted from coiled tubing injector apparatus 20. When tubing guide 15 is removed from coiled tubing injector apparatus 20, actuator linkages 262 will cause clamping slips 236 to converge and automatically clamp the coiled tubing 11 as is described above.

Tubing guide 15 may also have a secondary carrier arm 372. Secondary carrier arm 372 has a pair of opposed side plates 374 with a plurality of rollers 376 connected therebetween to help guide coiled tubing 11 into coiled tubing injector apparatus 20. FIG. 13 shows the secondary carrier arm 372 in a closed position. Secondary carrier arm 372 may be moved to an open position simply by grasping a handle 378 and pulling outwardly away from primary carrier arm 24. Handle 378 has a slot 380 defined therein in which a lug 382 that is fixed to secondary carrier arm 372 is received. Secondary carrier arm 372 will pivot about a pin 384 as lug 382 moves in slot 380. When secondary carrier arm 372 is in the open position, coiled tubing 11 may be inserted over primary carrier arm 24. Once coiled tubing 11 has been inserted, secondary carrier arm 372 can be rotated to the position shown in FIG. 9.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, and thereby enable others skilled in the art to best utilize the invention and various embodiments with various modifications that are suited to the particular use contemplated. It is intended that the scope of the invention be defined by the claims appended hereto and their equivalents.

What is claimed is:

1. A tubing guide for directing coiled tubing into an injector apparatus comprising:

a base;

a carrier arm extending upwardly from the base; and a pair of clamping slips disposed in the carrier arm;

wherein the clamping slips are movable between an open position wherein the coiled tubing can pass between the clamping slips and through the base without being engaged by the clamping slips, and a closed position wherein the clamping slips engage the coiled tubing so that the coiled tubing is secured to the tubing guide when the tubing guide with the coiled tubing passing therethrough is moved to the injector apparatus or is removed from the injector apparatus.

2. The tubing guide of claim 1 wherein the carrier arm comprises:

first and second side plates; and a tubing support mounted to the side plates for supporting the coiled tubing, wherein the clamping slips are disposed between the side plates.

3. The tubing guide of claim 2 further comprising a plurality of guide pins, wherein each clamping slip has first and second sides from which the guide pins extend, and the guide pins are disposed and movable in guide slots defined in the side plates.

4. The tubing guide of claim 3 wherein the guide slots have upper and lower ends, and the clamping slips move toward the upper end of the guide slots to move to the closed position.

5. The tubing guide of claim 3 wherein each side plate has center, forward, and rear guide slots, and the forward and rear guide slots converge from lower ends to upper ends thereof.

6. The tubing guide of claim 2 further comprising an actuator linkage connected to the clamping slips for moving the clamping slips between the open and closed position, wherein the actuator linkage comprises:

first and second outer links, wherein each of the first and second outer links has rear and forward ends, the first outer ink is pivotally connected between its rear and forward ends to the first side plate, and the second outer link is pivotally connected between its rear and forward ends to the second side plate; and a spring connected to at least one of the first and second outer links to cause the first and second outer links to rotate and urge the clamping slips to the closed position.

7. The tubing guide of claim 1 wherein each clamping slip has a generally V-shaped gripping surface.

8. The tubing guide of claim 1 wherein each clamping slip comprises:

a lower face;

an upper face;

first and second ends; and left and right sides;

wherein the upper face defines a gripping surface, and the upper face slopes from the first to the second end of the clamping slip.

9. The tubing guide of claim 8 wherein the gripping surface is a generally V-shaped surface, and the height of the gripping surface decreasing from the first to the second end of the clamping slip.

10. The tubing guide of claim 1 wherein the clamping slips automatically move from the open to the closed position when the tubing guide is removed from the injector apparatus.

11. The tubing guide of claim 1, wherein the clamping slips automatically move to the closed position when the tubing guide is removed from the injector apparatus.

12. A tubing guide for directing coiled tubing into a coiled tubing into a coiled tubing injector comprising:

a base;

a carrier arm extending upwardly from the base; and a clamping apparatus for clamping the coiled tubing to the tubing guide;

wherein the clamping apparatus automatically clamps the coiled tubing to the tubing guide when the tubing guide is moved from a coiled tubing installation location to the coiled tubing injector, the clamping apparatus automatically releases the coiled tubing when the tubing guide is placed on the coiled tubing injector, and the clamping apparatus automatically clamps the coiled tubing to the tubing guide when the tubing guide is removed from the coiled tubing injector.

13. The tubing guide of claim 12 wherein the clamping apparatus comprises a pair of clamping slips slidably disposed in the carrier arm, and wherein the coiled tubing passes between the clamping slips.

14. The tubing guide of claim 13 wherein the clamping slips have opposed gripping faces for engaging and clamping the coiled tubing.

15. The tubing guide of claim 13 wherein the carrier arm comprises first and second side plates, and wherein the clamping slips are positioned between the first and second side plates.

16. The tubing guide of claim 15 further comprising a plurality of pins, wherein each clamping slip has first and second sides from which the pins extend, and the pins are slidably received in guide slots defined in the side plates.

17. The tubing guide of claim 16 wherein:

the clamping slips comprise forward and rear clamping slips;

each side plate has forward and rear guide slots;

the forward and rear guide slots in each side plate converge from a lower end to an upper end thereof;

the pins extending from the forward clamping slip travel in the forward guide slots; and the pins extending from the rear clamping slip travel in the rear guide slots.

18. The tubing guide of claim 13 wherein:

the clamping apparatus further comprises an actuator linkage connected to the clamping slips;

the actuator linkage moves the clamping slips to a closed position to clamp the coiled tubing when the tubing guide is removed from the installation location or from the coiled tubing injector; and the actuator linkage moves the clamping slips to an open position wherein the coiled tubing is released when the tubing guide is placed on the coiled tubing injector.

19. A clamping slip in combination with a tubing guide, comprising:

a first end;

a second end;

a bottom face; and an upper face;

wherein a gripping surface is defined on the upper face, and the upper face is sloped so that the height of the clamping slip decreases from the first to the second end, the clamping slip being associated with the tubing guide so that a pair of clamping slips will clamp coiled tubing to the tubing guide.

20. The clamping slip of claim 19 wherein the gripping surface comprises a generally V-shaped surface, and the gripping surface has a height that decreases from a maximum height at the first end to a minimum height at the second end of the clamping slip.

21. The pair of clamping slips of claim 19 in combination with the tubing guide, wherein the clamping slips automatically move from a closed, clamping position, to an open position to allow coiled tubing to move therethrough when the tubing guide is positioned on a coiled tubing injector apparatus.

22. The pair of clamping slips of claim 21, wherein the clamping slips automatically move to the closed position when the tubing guide is removed from the coiled tubing apparatus.

* * * * *